US005452063A

United States Patent [19]

Fletcher

[11] Patent Number: 5,452,063

[45] Date of Patent: Sep. 19, 1995

[54] INTERMEDIATE TRANSFER WITH HIGH RELATIVE HUMIDITY PAPERS

[75] Inventor: Gerald M. Fletcher, Pittsford, N.Y.

[73] Assignee: Xerox Corporation, Stamford, Conn.

[21] Appl. No.: 176,378

[22] Filed: Jan. 3, 1994

[51] Int. Cl.[6] ..... G03G 15/00

[52] U.S. Cl. ..... 355/271; 355/274

[58] Field of Search ..... 355/271, 274, 273, 275, 355/326 R, 279; 271/193

[56] References Cited

U.S. PATENT DOCUMENTS

| | | | |
|---|---|---|---|
| 3,830,589 | 8/1974 | Allen | 355/274 X |
| 3,976,370 | 8/1976 | Goel et al. | 355/274 |
| 4,023,894 | 5/1977 | Goel | 355/274 |
| 4,823,158 | 4/1989 | Casey et al. | 355/274 X |
| 4,055,380 | 10/1977 | Borostyan | 355/274 X |
| 5,119,140 | 6/1992 | Berkes et al. | 355/273 |
| 5,198,864 | 3/1993 | Fletcher | 355/274 |
| 5,243,392 | 9/1993 | Berkes et al. | 355/275 |
| 5,276,483 | 1/1994 | Hasegawa et al. | 355/208 |
| 5,303,013 | 4/1994 | Koike et al. | 355/271 |
| 5,347,353 | 9/1994 | Fletcher | 355/326 R |
| 5,354,641 | 10/1994 | Lima-Marques | 430/126 |

*Primary Examiner*—A. T. Grimley
*Assistant Examiner*—Thu A. Dang
*Attorney, Agent, or Firm*—Oliff & Berridge

[57] ABSTRACT

A toned image is formed on an image receiving member by an image forming apparatus. The image forming apparatus includes an intermediate belt, at least one image forming device, and a transferring device. In one embodiment, the intermediate belt includes a conductive substrate and a topcoat insulating layer to receive the toned image so as to avoid lateral conduction of charges. In another embodiment, the image forming apparatus includes an intermediate belt having a semi-conductive substrate and biasing means for biasing a transfer zone, pre-transfer zone and post-transfer area of the substrate.

32 Claims, 4 Drawing Sheets

INTERMEDIATE TRANSFER WITH HIGH RELATIVE HUMIDITY PAPERS

BACKGROUND OF THE INVENTION

1. Field of the Invention

This invention relates generally to a system for transferring a toned image in an electrostatographic printing apparatus. More particularly, this invention relates to an apparatus for enabling the transfer of toned images to high humidity conditioned papers.

2. Description of Related Art

Generally, electrostatographic copying is performed by exposing an image of an original document onto a substantially uniformly charged photoreceptive member. The photoreceptive member has a photoconductive layer. Exposing the charged photoreceptive member with the image discharges areas of the photoconductive layer corresponding to non-image areas of the original document while maintaining the charge in the image areas. Thus, a latent electrostatic image of the original document is created on the photoconductive layer of the photoreceptive member.

Charged developing material is subsequently deposited on the photoreceptive member. The developing material may be a liquid material or powder material. The developing material is attracted to the charged image areas on the photoconductive layer. This attraction converts the latent electrostatic image into a visible toned image. The visible toned image is then transferred from the photoreceptive member to an intermediate transfer belt and finally to a copy sheet to form a reproduction of the original document. In a final step, the photoconductive surface of the photoreceptive member is cleaned to remove any residual developing material to prepare the photoreceptive member for successive imaging cycles.

This electrostatographic copying process is well known. Analogous processes also exist in other statographic printing applications, such as, for example, ionographic printing and reproduction, where a charge is deposited on a charge retentive surface in response to electronically generated or stored images.

Typically, a corotron or other corona generating device transfers the developed toned images from the intermediate belt to a copy sheet. In corona induced transfer systems, the copy sheet is placed in direct contact with the toner image supported on the intermediate belt while a corona discharge is sprayed onto the back of the copy sheet. This corona discharge generates ions having a polarity opposite to that of the toner particles. The corona discharge causes charges and therefore electrostatic transfer fields to electrostatically attract and transfer the toner particles from the intermediate belt to the copy sheet.

Alternatively, electrostatic transfer fields and thus transfer can be induced by applying a potential difference to the substrate of a biased member, such as a bias transfer roll. The bias transfer roll contacts the copy sheet in the transfer zone and the substrate of the intermediate belt that originally supports the toner image.

Problems exist in the prior art when the transfer fields created by the transferring device cause charges to laterally conduct along the copy sheet. For example, in a high relative humidity environment, the copy sheet exhibits relatively low resistivity. The copy sheet therefore laterally conducts charge along the copy sheet. In many transfer configurations, if conductive surfaces are touching the copy sheet near the transfer zone, lateral conduction along the high humidity conditioned copy sheet can cause the potential of the copy sheet to go to the potential on these conductive members. When transferring toner from an intermediate belt to a high relative humidity conditioned copy sheet, an intermediate surface that is too conductive can be one of the conductive surfaces contacting the paper. Then, lateral conduction along the copy sheet can cause the potential of the copy sheet to go to the potential of the intermediate belt surface if the intermediate belt surface is in a critical conductivity range, especially if the contact dwell time of the paper and intermediate surface is long. The lateral conduction along the copy sheet can greatly lower or even reverse the polarity of the effective applied transfer field in the transfer zone and result in low transfer efficiency of the toner.

While the following discussion relates to a negative polarity toner system, a positive polarity system may also be similarly used with the polarity of the charges reversed as is known in the art. Low or reversal transfer fields occur, for example, in corona transfer field generation systems if the potential on the conductive surfaces contacting the high humidity conditioned paper near the transfer zone are near or more negative than the potential above the toner image on the intermediate surface prior to the transfer zone. This is because the applied charge concentration in the transfer zone flows laterally away from the transfer zone along the copy sheet. Therefore, the potential on the copy sheet in the transfer zone tends to flow to the potential of the conductors. It is mainly these potentials that determine the applied electrostatic fields in the transfer zone. Thus, when the potential on any nearby conductors is more negative than the potential above the toner image coming into the transfer zone, the transfer field reverses with high humidity conditioned papers to essentially prevent transfer efficiency of the toner image from the belt to the copy sheet. If the potential of the conductive members touching the paper is maintained to be substantially more positive (with negative polarity toners) than the potential above the toner image on the intermediate surface prior to the transfer zone, high electrostatic transfer fields can be achieved in the transfer zone to achieve greater transfer efficiency of the toner image from the belt to the copy sheet.

It is well known to provide a bias on nearby conductive baffles touching the paper to improve transfer of high humidity conditioned papers. In most cases, the applied potential on the nearby baffles is obtained by self biasing each of the baffles. Resistors, diodes, or other suitable electrical components are used to generate a voltage on the baffles due to lateral current flow along the paper from the charging sources in the transfer zone. The self bias approach allows improved transfer efficiency in most cases, but causes certain limitations due to high electrostatic fields in the pre-transfer zone prior to paper contact.

Lateral conduction of charge from the transfer field generating device can generate sufficiently high charge, and therefore electrostatic fields, in the pre-transfer zone to adversely affect the transfer of the toner. High transfer fields in the pre-transfer zone prior to intimate contact of the copy sheet to the toner image are undesirable since the high fields cause the toner to transfer across air gaps. This causes splatter of the toner past the edges of the image. High pre-transfer fields are also undesirable because they can lead to air breakdown when the Pasohen Curve is exceeded. Such air breakdown can cause toner charge polarity reversal and result in image defects and lower transfer efficiency. Pre-transfer air breakdown limits the applied transfer fields and also limits the transfer efficiency of the toner to the paper. The present invention presents certain transfer configurations with intermediate transfer systems that can prevent such undesirable conditions with high relative humidity conditioned papers.

In intermediate transfer systems, if the intermediate belt surface is too conductive, and if the contact dwell time of the high humidity conditioned paper past the region where the applied electrostatic field is generated is long, the potential difference between the intermediate belt and the copy sheet can be zero because of the lateral conduction of charge along the high humidity conditioned copy sheet to the highly conductive intermediate belt surface. This can result in nearly zero applied electrostatic transfer fields while the copy sheet is separating from the intermediate belt surface. This typically results in a lower toner transfer efficiency. The present invention presents certain intermediate belt surface resistivity conditions and certain bias transfer configurations that can prevent this from occurring.

SUMMARY OF THE INVENTION

A first preferred embodiment of this invention solves these problems by preventing high charge loss caused by lateral conduction along the copy sheet to the intermediate belt surface by providing a sufficiently insulating intermediate belt surface so that most of the charge on the high relative humidity conditioned copy sheet can not laterally conduct directly to the intermediate belt surface. This invention provides biased transfer device configurations capable of efficient transfer of toner images to high humidity copy sheets without the undesirable conditions of high pre-transfer fields.

A first preferred embodiment comprises an image forming apparatus forming a toned image on an image receiving member. The apparatus comprises: an intermediate belt, at least one image forming device, and a transferring device which transfers toned images from the belt to the image receiving member. The intermediate belt comprises a conductive substrate layer and an topcoat insulating layer which receives toned images from each of the image forming devices.

In a second preferred embodiment, an apparatus forms a toned image on an image receiving member. The apparatus comprises: an intermediate member having a semiconductive substrate, at least one image forming device, a transferring device which transfers the toned image on the belt to the image receiving member conductive means for biasing the image receiving member and biasing means for biasing the intermediate substrate. Conductive bias members, such as conductive bias rollers, contact the intermediate substrate in the pre-transfer zone, in the transfer zone, and in the post-transfer zone. The bias on each conductive bias roller is chosen to provide a low equivalent applied potential in the pre-transfer zone and a high equivalent applied potential in the transfer zone and the post-transfer zone prior to paper separation from the intermediate surface. Thereby, low applied transfer fields are maintained in the pre-transfer zone before the copy sheet contacts the intermediate belt, but high transfer fields are provided in and past the transfer zone.

The approach of using different biases along the intermediate can be combined with other practices in the art such as the use of an acoustic loosening device below the intermediate belt, which is generally used to reduce the electrostatic forces needed to transfer toner. Also, the apparatus using different biases along the paper and different biases along the semiconductive intermediate can obviously be combined, if desired, for some configurations.

BRIEF DESCRIPTIONS OF THE DRAWINGS

The invention is described in detail with reference to the following drawings, in which like reference numerals refer to like elements, and wherein.

DETAILED DESCRIPTION OF PREFERRED EMBODIMENTS

Figure 1:
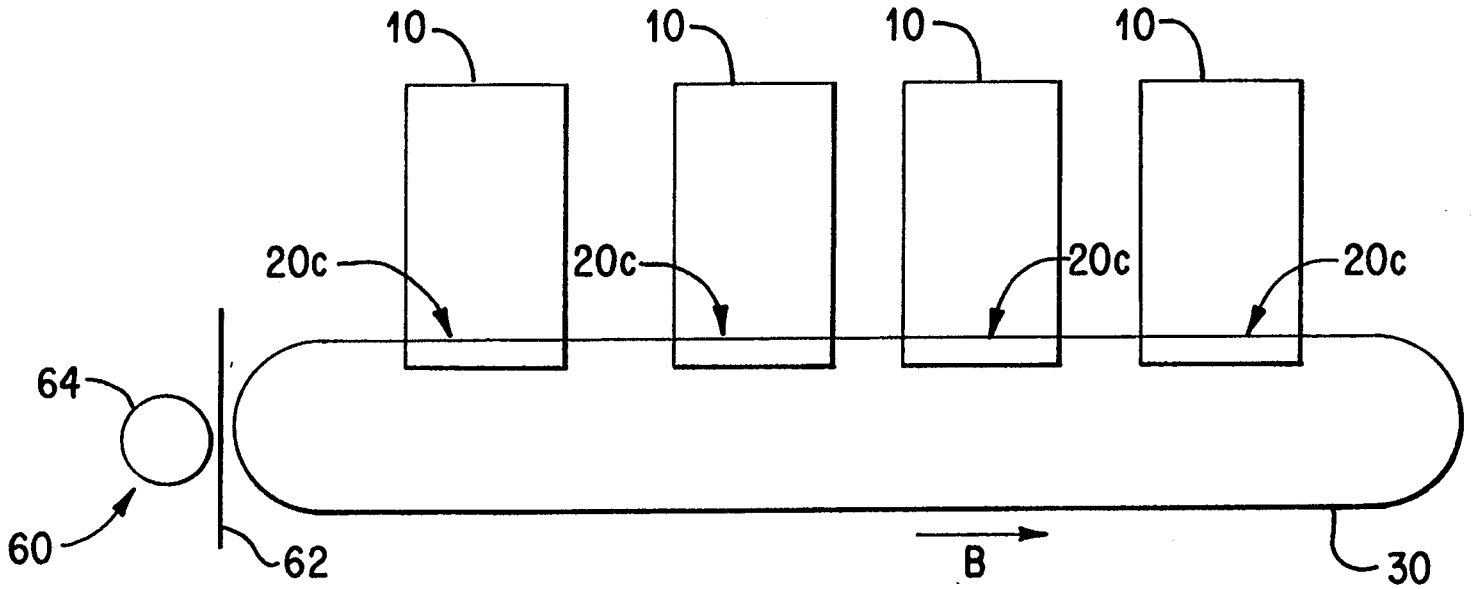
FIG. 1 is a schematic diagram of an electrostatographic printing machine incorporating the features of the invention.

As shown in FIG. 1, an electrophotographic copying apparatus may comprise four image forming devices 10. Each image forming device 10 forms and transfers a toned image onto the intermediate belt 30. In a preferred embodiment, four imaging devices 10 are used to provide conventional tandem color printing. Each of the imaging devices forms and transfers one of the tandem colors of yellow, cyan, magenta and black. Although the preferred embodiment is described with respect to the imaging drum system of FIG. 2, it is understood that a variety of imaging systems can be employed to form and transfer toned images to the intermediate belt 30. Furthermore, it is understood that any reasonable number of image forming devices may be incorporated into the copying apparatus, depending on the desired printing operation.

Figure 2:
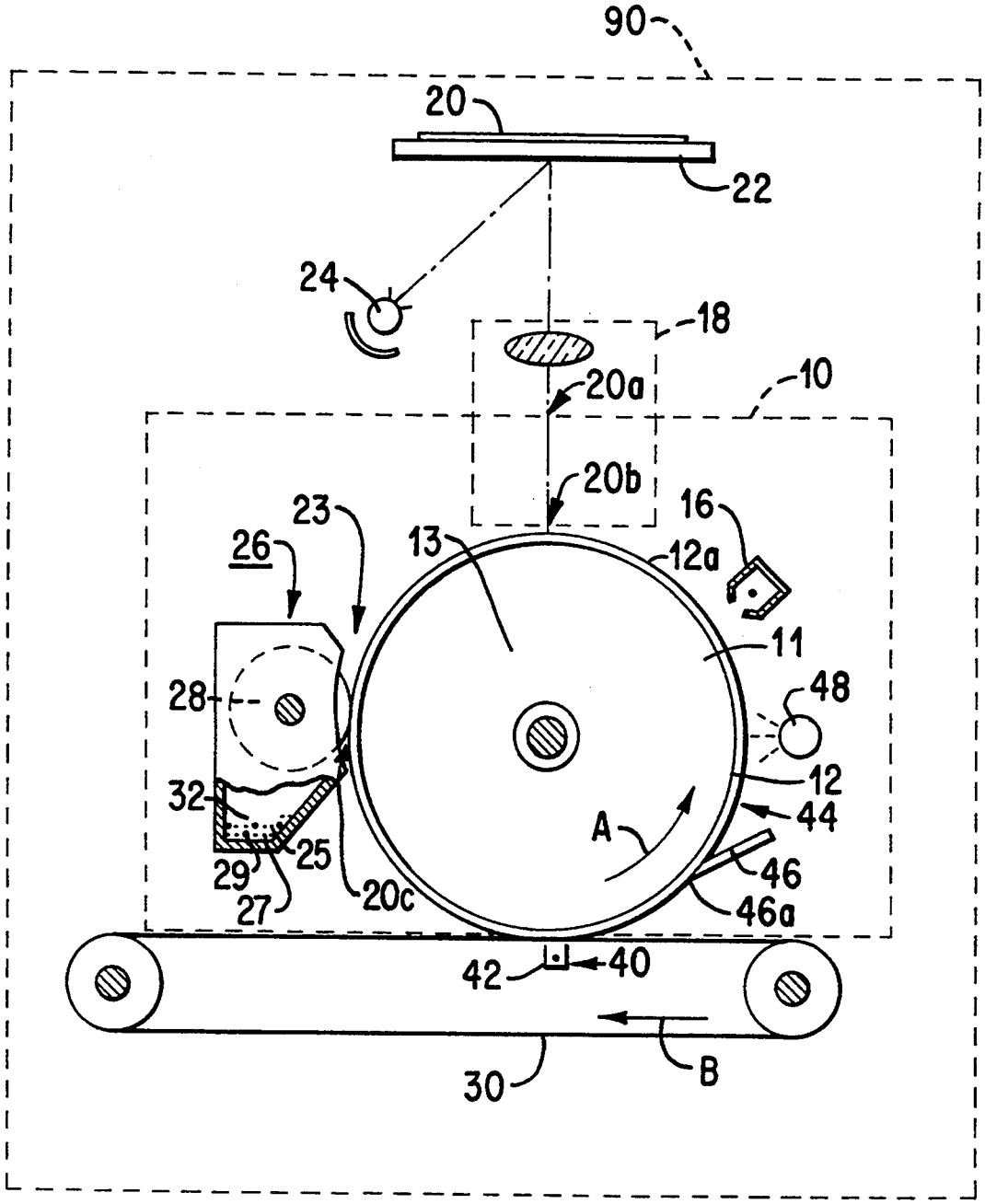
FIG. 2 is a schematic diagram of pertinent portions of the photoreceptive imaging drum system.

As shown in FIG. 2, the image forming device 10 comprises a drum 11 having an electrically grounded, conductive substrate 13. A photoconductive layer 12 is deposited on the electrically grounded conductive substrate 13. A series of processing stations for charging, exposing, developing, transferring and cleaning are positioned about the drum 11. As the drum 11 rotates in the direction of arrow A, the drum 11 transports a portion of the photoconductive surface 12*a* of the photoconductive layer 12 sequentially through each of the processing stations. The drum 11 is driven at a predetermined speed relative to the other machine operating mechanisms by a drive motor (not shown). Timing detectors (not shown) sense the rotation of the drum 11 and communicate with machine logic (not shown) to synchronize the various operations of the copying apparatus so that the proper sequence of operations is produced at each of the respective processing stations. It is understood that a variety of imaging surfaces having a photoreceptive layer may be employed in place of the drum 11 including a belt.

Initially, the drum 11 rotates the photoconductive layer 12 past the charging station 16. The charging station 16 is generally a corona generating device. The charging station 16 sprays ions onto the photoconductive surface 12*a* to produce a relatively high, substantially uniform charge on the photoconductive layer 12.

Once the photoconductive layer 12 is charged, it is rotated by the drum 11 to an exposure station 18 where a light image of an original document is projected onto the charged photoconductive surface 12*a*. The exposure station 18 is generally a laser ROS but it could also be a moving lens system. An original document 20 is positioned upon a generally planar, substantially transparent platen 22. A plurality of lamps 24 are synchronously moved with the lens system 18 to incrementally scan the original document 20 onto the photoconductive surface 12*a*. In this manner, a scanned light image 20*a* of the original document 20 is projected onto the photoconductive surface 12*a* of the drum 11. The scanned light image 20*a* selectively dissipates the charge on the photoconductive surface 12*a* to form a latent electrostatic image 20*b* corresponding to the image of the original document 20. While the preceding description relates to a light lens system, one skilled in the art will appreciate that other devices, such as a modulated laser beam can be employed to selectively discharge the charged photoconductive layer 12 to form the latent electrostatic image 20*b*.

After exposure, the drum 11 rotates the latent electrostatic image 20*b* formed on the surface 12*a* of the photoconductive layer 12 to a development station 23. For illustration purposes, the development station 23 is a developer unit 26, comprising a magnetic brush development system to deposit developing material 25 onto the latent electrostatic image 20*b*. The magnetic brush development system 26 includes a single developer roll 28 disposed in a developer housing 32. In the developer housing 32, toner particles 27 are mixed with carrier beads 29 to generate an electrostatic charge between the toner particles 27 and the carrier beads 29. The electrostatic charge causes the toner particles 27 to cling to the carrier beads 29 to form the developing material 25. The developer roll 28 rotates and attracts the developing material 25.

Subsequently, as the single developer roll 28 rotates, developing material 25 is bought into contact with the photoconductive surface 12*a*. The latent electrostatic image 20*b* formed in the photoconductive layer 12 attracts the charge toner particles 27 of the developing material 25 to develop the latent electrostatic image 20*b* on the photoconductive surface 12*a* into a toned image 20*c*. Many other toner development systems are well known in the art. Also, this invention is not limited to dry toner development systems and can be used as well with liquid development systems.

At a first transfer station 40, the developed toner image 20*c* is electrostatically transferred to an intermediate belt 30. Typically, transferring the toner image 20*c* between a drum 11 and an intermediate belt 30 in the electrostatographic apparatus is accomplished by electrostatic induction using a corotron 42 or other corona generating devices.

In corona induced transfer systems, the intermediate belt 30 is placed in direct contact with the toner image 20*c* while the toner image 20*c* is supported on the drum 11. By spraying the back of the intermediate belt 30 with an opposite polarity corona discharge, the toned image 20*c* on the drum 11 transfers to the intermediate belt 30. Alternatively, applying a potential difference between the conductive substrate 13 of the drum 11 and the intermediate belt 30 transfers the toned image 20*c*.

Invariably, some residual carrier beads and toner particles adhere to the photoconductive surface 12*a* of the drum 11 after the toned image 20*c* is transferred to the belt 30. These residual toner particles and carrier beads are removed from the photoconductive surface 12*a* at a cleaning station 44. The cleaning station 44 includes a flexible, resilient blade 46, which has a free end portion 46*a* contacting the photoconductive layer 12 to remove any adhering material. Thereafter, a lamp 48 is energized to discharge any residual charge remaining on the photoconductive surface 12*a*, in preparation for a successive imaging cycle.

As shown in FIG. 1, once the toned image 20*c* is transferred to the intermediate belt 30 from an image forming device 10, the belt 30 rotates in a direction indicated by the arrow B. If a plurality of image forming devices 10 are used, such as in tandem color printing, then subsequent toned images 20*c* are transferred to the belt 30 from the remaining image forming devices 10. In the preferred embodiment, each toned image 20*c* from each of the image forming devices 10 is superimposed on top of the previously transferred image(s) on the belt 30 to form a multi-layered toned image, corresponding to the image of the original document 20. However, it is understood that the preferred embodiment is not limited to a multi-layered toner image.

The toned image and the belt 30 continue rotating to a second transfer station 60. The second transfer station 60 transfers the toned image on the belt 30 to a copy sheet 62. At the transfer station 60, an output copy sheet 62 moves into contact with the toned image on the belt 30. In the illustrated embodiment, a bias transfer roller 64 establishes a directional electrostatic field capable of attracting toner particles on the belt 30. The bias transfer roller 64 attracts toner particles from the belt 30 to transfer the toned image from the belt 30 to the copy sheet 62. The bias transfer roller 64 also produces a pressure contact force against the copy sheet 62 to insure intimate contact between the copy sheet 62 and the toned image on the belt 30. The pressure contact substantially eliminates any large air gaps between the belt 30 and the bias transfer roller 64 to enable a highly efficient transfer.

Alternatively, a corotron (not shown) is used to transfer the toned image from the belt 30 to the copy sheet 62. The corotron sprays ions onto the back side of the copy sheet 62 to attract the toner particles from the belt 30 to the copy sheet 62.

In the transfer station 60, a transfer zone is defined by the area directly between the bias transfer roll 64 and the copy sheet 62. Similarly, the transfer zone in a corona induced system is the area directly between the corotron and the copy sheet 62.

As described above, the resistivity of the copy sheet 62 varies dramatically, depending on the relative humidity of the copy sheet 62. At low humidity, the copy sheet 62 has a high resistance. Thus, any charge on the copy sheet 62 does not easily move laterally along the copy sheet 62. Therefore, it is desirable to operate the apparatus in a low relative humidity environment to efficiently transfer the toner image from the belt 30 to the copy sheet 62. This, however, is not always possible. In a high or medium relative humidity environment, a charge on the copy sheet 62 is likely to move laterally. That is, when the relative humidity of the copy sheet 62 is high or medium, the repulsive electrostatic force of the closely spaced negative charges on the copy sheet 62 overcomes the electromagnetic friction between the charges and the copy sheet 62. However, in order for the charge to move laterally along the copy sheet 62, the copy sheet 62 must be in contact with a conductive surface to form an electrical path for the charge.

In conventional imaging devices, the intermediate belt often includes a photoconductive layer on a conductive substrate. Therefore, it is common, when operating in a high or medium humidity environment, for the charge on the copy sheet 62 to laterally conduct from the transferring device to the copy sheet 62 and finally to the conductive layer of the intermediate belt. This lateral conduction is driven by the potential gradient between the copy sheet 62 and the conductive member and acts to cancel out to the potential gradient.

Figure 3:
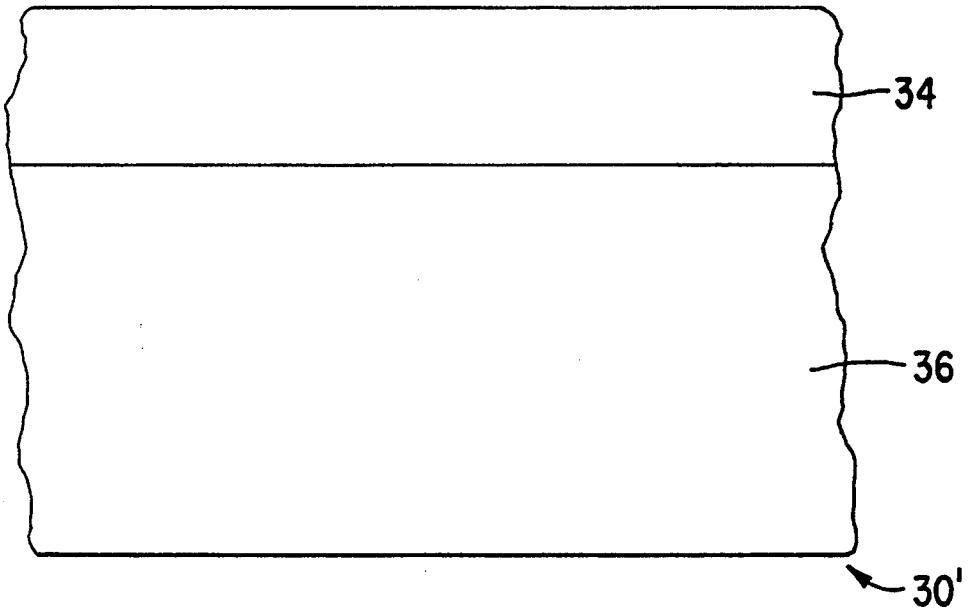
FIG. 3 is a plane side view of the intermediate belt of a first preferred embodiment of the present invention.

In order to solve the problems caused by the laterally conductive copy sheet 62, a first preferred embodiment utilizes an intermediate belt 30', as shown in FIG. 3. The intermediate belt 30' comprises a conductive substrate 36 and a thin insulating layer 34 deposited on the substrate 36 to receive toned images from the image forming devices. The thin insulating layer 34 is typically 0.0005 to 0.002 inches thick although other thickness are capable of use. The resistivity of the insulating layer 34 requires the lateral relaxation time along the surface of the belt 30' to be longer than the contact dwell time of the copy sheet 62 and the intermediate belt 30' in the transfer zone prior to copy sheet separation from the intermediate belt as described above. The dwell time depends upon the process speed of the printing apparatus and on the distance past the transfer zone to the contact points of the copy sheet 62 and the intermediate belt 30'. The lateral relaxation time depends on the square of the distances to the real contact points between the copy sheet 62 and the intermediate belt 30'. This prevents problems due to lateral conduction along the copy sheet 62 to the conductive layer 36 on the intermediate belt 30'.

The required resistivity of the insulating layer 34 increases directly as the contact dwell time increases between the copy sheet 62 and the intermediate belt surface. For example, with a one inch contact distance of the copy sheet 62 and intermediate belt 30' past the transfer zone, and a 10 in/sec. process speed, there would be about a 0.10 sec contact dwell time. Then, if the insulating layer 34 has a surface resistivity above about $2\times10^9$ ohm/square, transfer problems due to conduction of charge between the intermediate belt 30' and the copy sheet 62 can be avoided. To further illustrate, a five fold increase in the contact dwell time would require an insulating layer surface resistivity above about $1\times10^{10}$ ohm/square. On the other hand, a five fold decrease in the contact dwell time would require an insulating layer surface resistivity above about $4\times10^8$ ohm/square. In general then, paper separation closer to the transfer field generation device is preferred because it causes shorter dwell times and therefore allows a lower insulating layer surface resistivity. Higher process speeds also allow lower surface resistivity intermediate belt surfaces. If the insulating layer surface resistivity is very high, then very long dwell times due to a long dwell distance or slow process speeds will not cause problems. The surface resistivity is generally greater than $10^9$ ohms/square. However, in a more preferred embodiment, the surface resistivity is between approximately $10^9$ and $10^{12}$ ohms/square.

Thus, when the bias transfer roller 64, or similar transferring device, places an electrical charge on the copy sheet 62 in the second transfer zone 60, the electrical charge does not laterally conduct along the copy sheet 62 to the belt 30', since the belt 30' includes an insulating surface 34. If the charge on the copy sheet 62 does not electrically contact a lower electric potential, then the electric charge does not have a path through the potential gradient. Therefore, since any movement of the mutually repulsive charge increases, rather than decreases, the local potential gradient does not move. That is, although the electromagnetic friction between the charges and the copy sheet 62 remains low, the repulsive force between the charges maintains the stability of the system, as there is no low energy path available to the charges. Therefore, the insulating layer 34 on the intermediate belt 30' prevents high or medium humidity copy sheets 62 from laterally conducting to the intermediate belt 30'.

Figure 4:
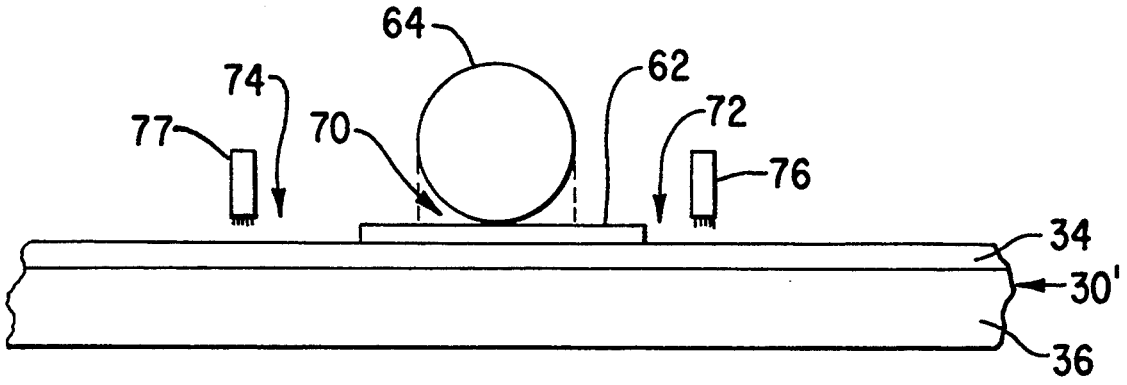
FIG. 4 is a schematic diagram of the transfer station of the first preferred embodiment of the present invention.

As shown in FIG. 4, different potential differences are created in both the pre-transfer zone 72 and the transfer zone 70 between the high humidity conditioned copy sheet 62 and the intermediate belt 30'. As previously discussed, a conductive bias transfer roller 64 is preferably provided in the transfer zone 70 to ensure a high desired potential difference in the transfer zone 70 and to provide intimate pressure contact between the copy sheet 62 and the intermediate surface 30'. Other biasing means, such as a corona device, may also be provided, as is known in the art.

Low fields are also produced in the pre-transfer zone 72 using a conductive shim baffle 76, or similar device known in the art, contacting the copy sheet 62 in the pre-transfer zone 72. Accordingly, the pre-transfer region 72 is provided with a very low electrostatic field while the transfer zone 70 has a high electrostatic field. Thus, the intermediate belt 30' and the copy sheet 62 will have at least two different electric potentials. This ensures an efficient transfer of the toner image from the belt 30' to the copy sheet 62. Similarly, the potential in the post-transfer zone 74 may be appropriately set in a similar manner. If the copy sheet separation point (for the removal of the copy sheet 62 from the intermediate belt 30') is away from the transfer zone 70, then it is generally necessary to use a baffle 77 in the post-transfer zone. Baffle 77 is typically biased at the same high field potential as the bias transfer roller 64. However, if the paper separation point is close to the transfer zone 70, then a baffle 77 may not be necessary.

The copy sheet 62 is then transported out of the transfer zone 70 and is physically removed from the belt 30' in a well known manner. The preferred stripping mechanism is a conventional "self stripping" apparatus. Alternatively, a stripping assist device, such as a detach corona generating device, a vacuum generating device or a stripper finger, are used to direct the copy sheet 62 away from the belt 30' and towards a fusing station. The fusing station may include rollers (not shown) to permanently fuse the toner image to the copy sheet 62 in a conventional manner.

Figure 5:
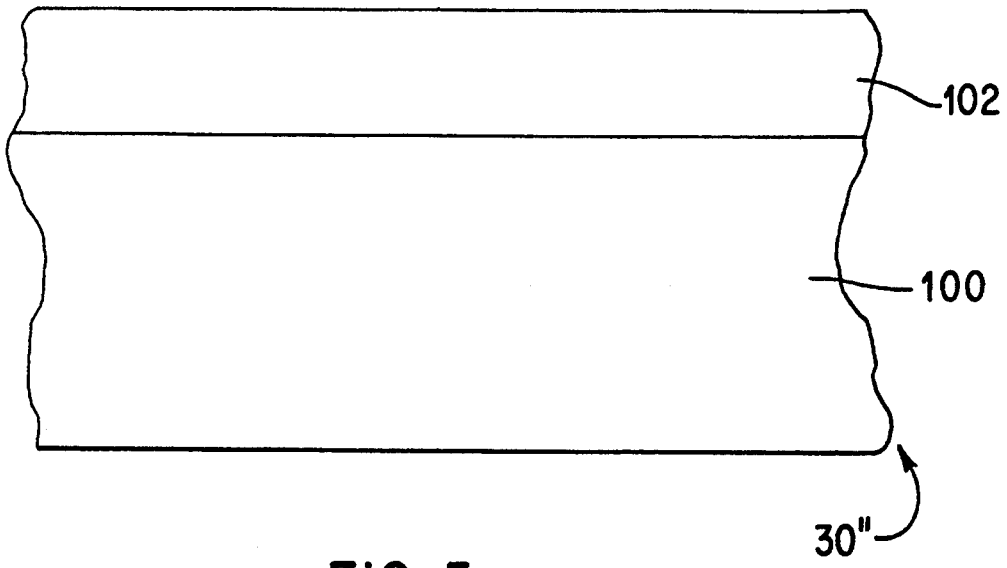
FIG. 5 is a plane side view of the intermediate belt of a second preferred embodiment of the present invention.
Figure 6:
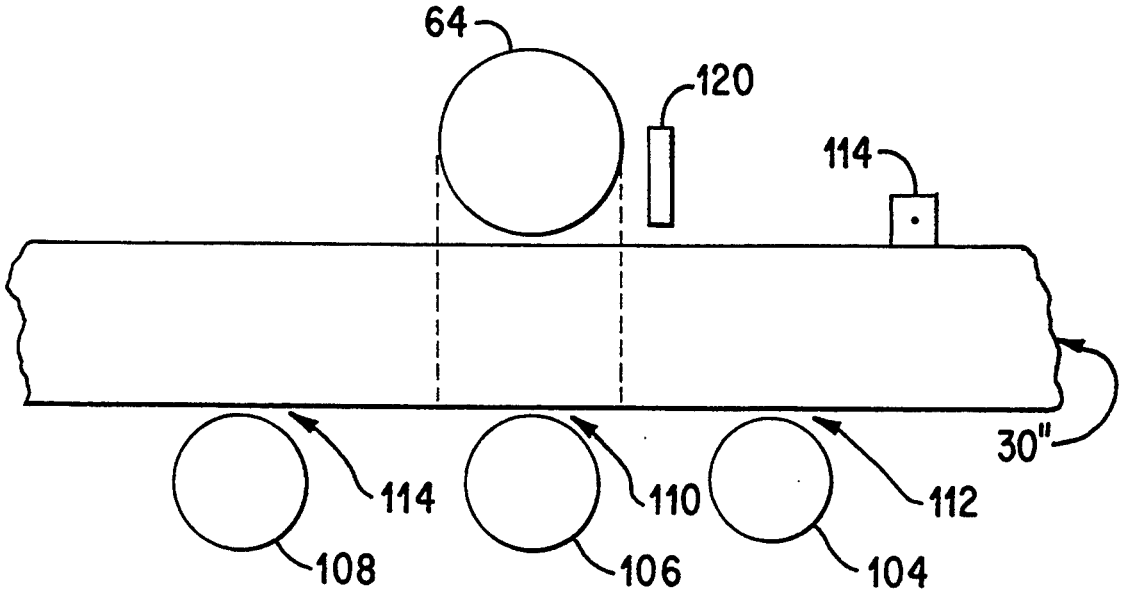
FIG. 6 is a schematic diagram of an electrostatographic printing machine incorporating the features of the second embodiment of the invention.

A second preferred embodiment is shown in FIGS. 5 and 6. However, in the second preferred embodiment, the belt 30'' comprises a semiconductive substrate layer 100 and may also include a topcoat insulating layer 102 as shown in FIG. 5.

The printing apparatus of the second embodiment operates in similar manner to that described above. However, the second embodiment incorporates additional features to prevent electrical charges from laterally conducting along the copy sheet 62 while in the transfer station 60 of FIG. 1.

After the toned image is formed on the belt 30'' of FIG. 6, the copy sheet 62 is moved into contact with the toned image on the belt 30'' by a sheet feeding apparatus (not shown) as is well known in the art.

The substrate 100 of the intermediate belt 30'' of the second preferred embodiment is semiconductive rather than conductive with a lateral or surface resistivity of the substrate 100 greater than $10^7$ ohm/square and a volume resistivity typically below about $10^{12}$ ohm-cm. To allow the substrate 100 to be in the lower resistivity range of these specifications without problems due to lateral conduction along the copy sheet 62, the substrate 100 is covered with a thin, typically around 0.0005 to 0.002 inch, topcoat insulating layer 102 to meet the sufficiently high lateral resistivity requirements of the intermediate surface facing the copy sheet 62, as is discussed above. If the surface resistivity of the intermediate substrate 100 is maintained above the threshold surface resistivity discussed above to avoid lateral conduction problems between the high humidity copy sheet 62 and the intermediate belt surface, then the topcoat insulating layer 102 is not needed. For example, in a system having a 0.1 sec dwell time, if the substrate resistivity is about $2\times10^9$ ohm/square, then the topcoat insulating layer 102 is not needed. For field sensitive and environmentally sensitive materials, this resistivity condition must be met throughout the applied field, environmental and life conditions of the intermediate transfer system. In a more preferred embodiment, the semiconductive substrate 100 has a lateral resistivity between $10^7$ and $10^{12}$ ohm/square.

U.S. Pat. No. 5,198,864 to Fletcher, the subject matter of which is incorporated by reference, teaches potentials caused by surface, volume, or toner on the surface transporting the toner behave equivalently in magnitude to applied potentials on conductive members. It is further taught that an equivalent applied potential (as compared to the applied potential) is important for determining the fields. An equivalent applied potential in any region of a semiconductive intermediate belt system is the applied potential on the copy sheet surface minus the potential due to trapped charges on the surface (or volume) of the intermediate belt materials, minus the applied potential on the intermediate belt substrate. Generally, the equivalent applied potential in different regions of the intermediate belt allows high quality transfer with a high efficiency when transferring to high humidity conditioned papers.

With a conductive layer on the intermediate belt as in the prior art, only one potential is maintained on the intermediate belt substrate. Then, in order to utilize the principals taught in U.S. Pat. No. 5,198,864, different bias conditions at the pre-transfer zone and transfer zone are needed. However, with a semiconductive intermediate substrate 100 of the second preferred embodiment, the substrate potential is different in the pre-transfer zone 112, the transfer zone 110 and the post-transfer zone 114. This can be done, for example, by contacting the intermediate belt substrate 100 to different biased conductive members in the various zones 110, 112 and 114. Then, the potential of the high humidity conditioned copy sheet 62 can be a single potential along the copy sheet 62 while the equivalent applied potential is different in the different zones (pre-transfer zone 112, transfer zone 110, and post-transfer zone 114). For reference, as shown in FIG. 6, the transfer zone 100 is considered to be the area immediately between a transferring device, such as a bias transfer roller 64 and the intermediate belt 30''. The pre-transfer zone 112 is considered to be the area on the intermediate belt 30'' immediately prior to the transfer zone 110. The post-transfer zone 114 is the area immediately following the transfer zone 100 as the intermediate belt 30' is rotated.

If negative polarity toner is used, for example, to transfer the copy sheet 62, the high relative humidity conditioned copy sheet 62 contacts at least one conductor 120 near or in the transfer zone 110. In one embodiment, the conductor 120 will be grounded so that the copy sheet 62 will be substantially at zero potential prior to, in, and past the transfer zone, due to lateral conduction along the copy sheet 62 to the conductor 120. Additional conductors 120 may be positioned immediately after the transfer zone 110 if necessary depending on a variety of factors, such as the distance to the paper separation point.

In the second preferred embodiment, the equivalent applied potential in the pre-transfer zone 112 is a suitably low potential by choosing the potential applied to, for example, a conductive roller 104, or similar device, contacting the intermediate substrate 100 in the pre-transfer zone 112 as shown in FIG. 6. The chosen applied potential on the conductive roller 104 takes into account the potentials due to trapped surface, volume or toner charge on the top surfaces of the intermediate belt 30'' to achieve a desirable low equivalent applied potential. Similarly, the applied potential on the semiconductive intermediate belt substrate 100 is chosen to be different in the transfer zone 110 and post-transfer zone 114 to achieve a high equivalent applied potential for creating high transfer fields. This is similarly done using conductive rollers 106 and 108, in the transfer zone 110 and the post-transfer zone 114, respectively.

By properly choosing different potentials on the semiconductive intermediate belt substrate 100 near the transfer zone 110, undesirable conditions of high pre-transfer zone fields can be avoided while still maintaining very high transfer fields in and beyond the transfer zone 110. Generally, this approach requires the substrate lateral resistivity to be above approximately $10^7$ ohm/square, due to very high lateral current requirements between the regions of different potentials on the intermediate belt substrate 100. This lower limit depends on a variety of factors such as the distance between the different biases applied to the intermediate belt substrate 100, on the applied voltage differences needed, and on the amount of lateral current flow that will be allowed by the power supply design or by safety considerations. A more preferred embodiment has a substrate lateral resistivity above approximately $10^8$ ohm/square.

Different potentials on the conductor 120 touching the copy sheet 62 can be used rather than the ground potentials as described above. The applied potentials on the intermediate substrate 100 must then be appropriately shifted by the copy sheet bias condition (as generally controlled by the conductors 120) to achieve the desired optimum equivalent applied potentials in the various zones. Similarly, the potentials due to trapped surface, volume, or toner charge on the intermediate belt 30'' must be included to choose the required applied potentials on the intermediate substrate 100. These latter potentials can be affected and controlled by, for example, a pre-transfer corona device conditioning of the intermediate belt 30″. A scorotron corona device 114, as shown in FIG. 6, is effective in levelling the potentials of the intermediate surface, as is well known in the art. Without a voltage levelling approach prior to the copy sheet transfer, the potential above the intermediate belt 30″ prior to the second transfer station 60 can be very different in high pile height toner image regions made up of three color layers, rather than in, for example, lower pile height image regions made up of only one color. Then, the equivalent applied voltages can be different for the various types of images for the same applied voltages. In some cases, this can result in operating latitude problems. Thus, a pre-transfer levelling of the intermediate belt potential prior to the second transfer station 60 is preferred for most systems. It can be appreciated that the actual requirements will depend on factors such as the toner adhesion forces, the toner charge, and the pile height of the toner images, among other things.

In most systems using negative polarity toner, the desired equivalent potential in the pre-transfer region 112 will be near zero but will usually be allowed to be between approximately plus or minus 400 volts of zero. Typically, the equivalent applied voltage desired for the posttransfer zone 114 will be near 1200 volts, but can be in the range between about 800 and 2000 volts. The actual requirement will depend on the various factors mentioned above.

The applied potentials on the substrate 100 can be different in the different zones near the transfer zone 110 by contacting the semiconductive intermediate substrate 100 with a plurality of conductive bias rollers having different potentials. However, intimate contact of the bias rollers 104, 106 and 108 to the intermediate substrate 100 is generally necessary to avoid a high potential difference between the respective roller and the intermediate substrate 100 due to poor contact. Accordingly, the bias rollers 104, 106 and 108 often have a conformable or spongy outer covering to help insure this, or else the roller configuration can create a wrapped contact with the intermediate substrate 100. In order for a coating on the roller to be considered conductive, the resistance between the conductive roller core and the contact zone area between the respective roller and the intermediate surface must be somewhat smaller than the resistance along the intermediate belt 30″ between the different rollers. As an example, with a single homogenous layer roller coating, the resistance of the coating will be the coating volume resistivity times the coating thickness divided by the roller contact area with the intermediate belt 30″ (which is the contact nip width times the bias roll length). The lateral resistance along the intermediate belt 30″ between rollers will be the lateral resistivity along the substrate 100 times the distance between the rollers divided by the bias roller length. For example, if the intermediate substrate lateral resistivity is above about $10^8$ ohm/square, the distance between any two rollers is about 1 cm, the process width is about 40 cm, the roller coating thickness is 0.5 cm, and the width of the contact nip between the roller and the intermediate belt 30″ is about 0.5 cm, the resistivity of any overcoating on the bias roller must be below about $10^8$ ohm-cm. Of course, more complex multilayered bias roller coatings are possible and then the resistance condition referred to above would more generally apply.

The applied potentials on the substrate 100 can also be obtained using a plurality of conductive continuous brush fiber blades contacting the substrate, or with a plurality of conductive shim blades or with other devices known in the art. Alternatively, the intermediate belt substrate 100 may contain embedded lines of conductive electrodes perpendicular to the process direction. These conductors can be suitably connected to different applied potentials near the transfer zone 110 to cause the desired equivalent applied potential differences in the pre-transfer zone 112 and transfer zone 110.

A bias roller 64 is often used on the copy sheet side of the transfer zone 110 to provide pressure between the copy sheet 62 and the intermediate belt 30″. Mechanical pressure is generally desired to create intimate contact between the copy sheet 62 and the intermediate surface 30″, and it is particularly desired with high humidity conditioned papers because paper distortion caused by moisture uptake can otherwise prevent intimate contact during transfer. Without intimate contact, the applied electrostatic fields will generally be too low to cause a good transfer. Additionally, a corotron transfer field generation system can also be used instead of a bias roller, and the desired mechanical pressure can be provided with contacting pressure blades, as is known and practiced in the art. The bias roller 82 is generally advantageous in that the pressure is applied during the applied fields while the corotron systems with a pressure blade tend to apply the pressure just before the applied fields are created. Still, in many cases the application of pressure substantially immediately before the applied field region is sufficient to insure that the electrostatic forces hold the distorted papers in intimate contact during the transfer zone. Additionally, an acoustic transfer assist device may be used as the transferring means as is well known in the art.

If a conductive bias roller 64 is used, the copy sheet 62 near the transfer zone 110 will be driven to the bias roller potential in the transfer zone 110. Generally, any coating on a bias roller having a resistivity below about $10^8$ ohm-cm can be considered to be conductive. If a relatively high resistivity bias roller coating is to be used, the high humidity paper potential can be driven to the potential on the conductive members contacting the paper near the transfer zone 110. In both cases, the equivalent applied potentials, and hence the applied transfer electrostatic fields, can be suitably chosen to be low in the pre-transfer zone 112 and high in the transfer zone 110 and the post-transfer zone 114.

While this invention was described with reference to preferred embodiments, it is understood that this invention is not limited to these preferred embodiments. On the contrary, it is intended that this invention cover all alternatives, modifications and equivalents as may be included within the spirit and scope of the invention as defined by the appended claims.

What is claimed is:

1. An image forming apparatus forming a toned image on an image receiving member, the image forming apparatus comprising:

an intermediate member comprising a conductive substrate and an insulating layer mounted on the conductive substrate, the insulating layer receiving the toned image, wherein the insulating layer has a lateral relaxation time along the intermediate member longer than a contact dwell time between the image receiving member and the intermediate member;

at least one image forming means for transferring the toned image to the insulating layer of the intermediate member;

transferring means for transferring the toned image on the insulating layer of the intermediate member to the image receiving member, the transferring means located in a transfer zone; and biasing means for biasing the image receiving member in a pre-transfer zone located upstream of the transfer zone.

2. The image forming apparatus of claim 1, wherein the insulating layer prevents electrical conduction of static electrical charges along the image receiving member.

3. The image forming apparatus of claim 1, wherein the insulating layer has a resistivity greater than $10^9$ ohms/square.

4. The image forming apparatus of claim 1, wherein the insulating layer has a resistivity between approximately $10^9$ and $10^{12}$ ohms/square.

5. The image forming apparatus of claim 1, wherein the insulating layer is approximately 0.0005 to 0.002 inches thick.

6. The image forming apparatus of claim 1, wherein the transferring means is a corona generating device.

7. The image forming apparatus of claim 1, wherein the transferring means is a bias transfer roller.

8. The image forming apparatus of claim 7, wherein the bias transfer roller provides physical pressure between the image receiving member and the intermediate member.

9. The image forming apparatus of claim 7, wherein the bias transfer roller applies a potential difference across the transfer zone.

10. The image forming apparatus of claim 1, wherein the at least one image forming means comprises a plurality of image forming means, and the toned image comprises a plurality of toned sub-images, each toned sub-image being formed by a separate one of the plurality of image forming means.

11. The image forming apparatus of claim 1, wherein the image forming means comprises at least one photoconductive drum.

12. The image forming apparatus of claim 1, wherein the image forming means comprises at least one intermediate belt.

13. The image forming apparatus of claim 1, wherein the intermediate member is a belt.

14. The image forming apparatus of claim 1, wherein the biasing means comprises a baffle contacting the image receiving member in the pre-transfer zone.

15. The image forming apparatus of claim 1, wherein the biasing means applies a lower electrostatic field in the pre-transfer zone than an electrostatic field in the transfer zone.

16. The image forming apparatus of claim 1, wherein the biasing means in the pre-transfer zone is a first biasing means, and the apparatus further comprising second biasing means for biasing the image receiving member in a post-transfer zone located downstream of the transfer zone.

17. An image forming apparatus forming a toned image on an image receiving member, the image forming apparatus comprising:

an intermediate member having a conductive substrate;

at least one image forming means for forming the toned image on a first surface of the intermediate member;

transferring means for transferring the toned image on the intermediate member to the image receiving member, the transferring means located in a transfer zone;

conductive means upstream of the transfer zone for biasing the image receiving member;

first biasing means, located along a second surface of the intermediate member, for biasing a first area of the conductive substrate corresponding to the transfer zone; and second biasing means, located along the second surface of the intermediate member, for biasing a second area of the conductive substrate corresponding to a pre-transfer zone located upstream of the transfer zone.

18. The image forming apparatus of claim 17, further comprising third biasing means, located along the second surface of the intermediate member, for biasing a third area of the conductive substrate corresponding to a post-transfer zone located downstream of the transfer zone.

19. The image forming apparatus of claim 17, wherein the intermediate member is a belt.

20. The image forming apparatus of claim 17, wherein the transferring means comprises a bias transfer roller.

21. The image forming apparatus of claim 17, wherein the transferring means comprises a corona generating device.

22. The image forming apparatus of claim 17, wherein the conductive substrate is covered by an insulating layer.

23. The image forming apparatus of claim 22, wherein the insulating layer is approximately 0.0005 to 0.002 inches thick.

24. The image forming apparatus of claim 17, wherein the conductive substrate has a lateral resistivity greater than $10^7$ ohm/square.

25. The image forming apparatus of claim 17, wherein the conductive substrate has a lateral resistivity between about $10^8$ and $10^{12}$ ohm/square.

26. The image forming apparatus of claim 17, wherein the conductive means comprise a conductor located upstream from the transfer zone to bias the image receiving member.

27. The image forming apparatus of claim 18, wherein the first biasing means, the second biasing means and the third biasing means comprise conductive rollers contacting the conductive substrate.

28. The image forming apparatus of claim 18, further comprising leveling means located upstream of the conductive means for leveling a surface potential of the toned image on the intermediate member prior to the transfer zone.

29. The image forming apparatus of claim 28, wherein the leveling means comprises a scorotron corotron device.

30. The image forming apparatus of claim 18, wherein the first biasing means, the second biasing means and the third biasing means are one of brush fiber blades contacting the conductive substrate and conductive shim blades contacting the conductive substrate.

31. The image forming apparatus of claim 17, wherein the transferring means comprises an acoustic transfer assist device.

32. The image forming apparatus of claim 18, wherein the conductive substrate has a volume resistivity less than $10^{12}$ ohm-cm.

* * * * *